US006488446B1

(12) United States Patent
Riemers

(10) Patent No.: US 6,488,446 B1
(45) Date of Patent: Dec. 3, 2002

(54) MARINE STRUCTURE

(75) Inventor: Mark Erik Riemers, Woerden (NL)

(73) Assignee: Suction Pile Technology BV, Woerden (NL)

( * ) Notice: Subject to any disclaimer, the term of this patent is extended or adjusted under 35 U.S.C. 154(b) by 0 days.

(21) Appl. No.: 09/647,427

(22) PCT Filed: Apr. 6, 1999

(86) PCT No.: PCT/NL99/00204

§ 371 (c)(1),
(2), (4) Date: Oct. 2, 2000

(87) PCT Pub. No.: WO99/51821

PCT Pub. Date: Oct. 14, 1999

(30) Foreign Application Priority Data

| | | |
|---|---|---|
| Apr. 2, 1998 | (NL) | 1008793 |
| Apr. 14, 1998 | (NL) | 1008873 |
| Jul. 29, 1998 | (NL) | 1009769 |
| Nov. 27, 1998 | (NL) | 1010666 |
| Jan. 6, 1999 | (NL) | 1010966 |
| Feb. 17, 1999 | (NL) | 1011326 |

(51) Int. Cl.[7] ..... B63B 21/27
(52) U.S. Cl. ..... 405/203; 405/224.1; 114/296
(58) Field of Search ..... 405/195.1, 203, 405/205, 207, 208, 223.1, 224, 224.1, 226–228; 114/296

(56) References Cited

U.S. PATENT DOCUMENTS

| | | | | | |
|---|---|---|---|---|---|
| 3,817,040 | A | | 6/1974 | Stevens | 405/228 |
| 4,257,721 | A | | 3/1981 | Haynes | 405/227 |
| 4,432,671 | A | * | 2/1984 | Westra et al. | 405/226 |
| 5,704,732 | A | * | 1/1998 | Horton, III | 405/228 |
| 5,964,550 | A | * | 10/1999 | Blandford et al. | 114/265 |
| 5,997,218 | A | * | 12/1999 | Børseth | 405/223.1 |
| 6,099,207 | A | * | 8/2000 | Bennett | 405/196 |

FOREIGN PATENT DOCUMENTS

| | | |
|---|---|---|
| EP | 0 011 894 | 6/1980 |
| WO | WO 95/20075 | 7/1995 |

* cited by examiner

*Primary Examiner*—Thomas B. Will
*Assistant Examiner*—Tara L. Mayo
(74) *Attorney, Agent, or Firm*—Young & Thompson

(57) ABSTRACT

Marine structure with one or more suction piles for embedment into the subsea bottom and with buoyancy sufficient such that the structure can be transported over water independently floating, including in an upright position, wherein the buoyancy is concentrated near the suction piles, and may be substantially in line with the suction piles, and wherein the buoyancy is such that if the suction piles touch the subsea bottom with their undersides, at least part of the buoyancy projects above the water surface.

20 Claims, 10 Drawing Sheets

100
16

(b)
1
(c)

MARINE STRUCTURE

BACKGROUND OF THE INVENTION

The invention is concerned with a marine structure, a suction pile and a method for installing a marine structure. The invention is particularly, though not exclusively, directed to the application of so called "minimal platforms".

DESCRIPTION OF THE RELATED ART

It is common to position a marine structure pre-assembled or in separate parts onto one or more barges or pontoons in a harbour and then tug said pontoons to the location of destination, whereafter the structure is lifted from the pontoons with the aid of a separate hoisting device and is then the structure is installed on the subsea bottom with the aid of that device, wherein prior to or after installing the structure onto the subsea bottom, a foundation therefor is made with the aid of a separate foundation pile ramming device.

Suction piles and their way of installing are o.a. known from GB-B-2300661 and EP-B-0011894, which desclosures are enclosed here by reference. Briefly, a suction pile is a thin walled steel cylinder, closed at at least one longitudinal end, that is located on the subsea bottom with the opposite end and penetrates the subsea bottom with the aid of a suction created within the cylinder. The creation of the suction can be with the aid of a suction source, such as a pump, being on, or close to or at a distance (e.g. above the water surface, e.g. at a vessel) from the suction pile. The applied level of the suction can be e.g. at least substantially constant, smoothly increase or decrease or else pulsate, for which there are convenient means; for an e.g. pulsating level a possibly in the suction pile integrated pressure accumulator that is intermittendly connected to the inner space of the cylinder. After use, the suction pile can easily be removed by creating an overpressure within the cylinder, e.g. by pumping in (sea) water.

SUMMARY OF THE INVENTION

According to one aspect the invention proposes to make the marine structure self floating and self foundating by providing it with buoyancy and one or more suction piles. So the hoisting device and the foundation plant can be eliminated. Preferably the structure has buoyancy of its own, e.g. obtained by the with the structure integrated appliance that is designed to, once the structure is installed, ballast the structure. Buoyancy can also be obtained from the suction pile, which for that can be provided with a floater. Said own buoyancy is preferably such that it is substantially contributing to the required buayancy to make the structure self floating. It is preferable, if the buayancy can be at least substantially decreased for installation purposes. By e.g. filling the one or more floating bodies with ballast, like water. Therefor it is convenient, to provide the structure with means for admitting and possibly removing of ballast, such as between the closed and open position switchable shutter valves in a water supplying respectively water venting opening to a ballast tank.

Since the structure is self floating and is provided with one or more suction piles, removal after use is made easier. On the one hand in that by pressing out the suction pile, the anchoring of the structure to the underwater bottom can be removed. On the other hand in that the structure can independently rise to the water surface by the (possibly regained) buoyancy.

The marine structure will typically be relatively small in this connection, e.g. a production platform with appliances. Because of its own weight, such a marine structure is designed to be used with a foundation of pile bodies to be rammed into the ground. Apart from the suction piles, such marine structure has, preferably, no floating bodies, neglecting parasitic floating bodies like ineviatbly present air filled spaces, such as frame tubes. The marine structure referred to here typically will weigh not more than about 50 tonnes.

Now it is no longer necessary to position the marine structure onto a barge for transport over water. This offers further advantages since the marine structure does not need to be lifted from the barge by a hoisting device. If the suction pile offers at least part of the required buoyancy, the marine device can be provided with fewer floating structures especially provided for said purpose, or such floating structures can even be eliminated.

As such, savings of costs, time, energy, environment and materialare possible and one can also work safer.

According to another aspect, the invention proposes to use the suction pile, or part thereof, as floating body of which the buoyancy is preferably adapted to keep itself floating. In this way it is e.g. possible, to take a suction pile independently floating in te water to its final destination, so without help of one or more auxiliary. floaters. Reclaiming such a suction pile is also made easier. On the one hand in that this can free itself independently from the subsea bottom with its buoyancy, once pressed upwardly but still partly standing in the subsea bottom. On the other hand since it can rise to the water surface independently. In particular the buoyancy of the suction pile according to the invention is substantially larger than its own weight, e.g. such that the suction pile alone or in combination with one or more other suctions piles substantially contributes to the marine structure with which it is integrated. Accordingly the invention proposes to provide the suction pile with a convenient buoyancy means.

The buoyancy means can be at least substantially comprise a space in open communication with the surrounding water at its under side, such as the pressure space of the suction pile, e.g. if the suction pile will at least as much upright as possible float in the water. If one can keep said space free of water to a satisfying level, the desired buoyancy can be maintained without requiring to delimit this floating space at all sides with respect to the water environment. Said space can therefor e.g. be connected to a convenient means, such as for delivering a gas generating dry compound into said space, or for delivering into said space a pressurised gas, such as a pump, to generate a convenient gas pressure in the suction space and to possibly maintain it against the pressure of the surrounding water. Due to the movements of the floating suction pile in the water, it is expected that without counter measurements this space will be filled more and more with water from below. A remedy is to continuously or intermittendly removing of the flowing in water by e.g. refilling said space with gas, for which said above mentioned means is/are continuously or intermittendly activated. In this connection it is preferred to integrate this means in an active, preferably automatic, e.g. electronic control circuit wherein said means is activated in dependency from the detection of the buoyancy of the suction pile at different times, such as by measuring e.g. the water level or e.g. the gas pressure within said space with e.g. a convenient sensor, outputting its measuring signal to an evaluation device comparing the measuring signal with an input value, switching on or letting switching on said means to get back to the initial situation once a treshold difference value is exceeded.

Application of the above described space in open communication with its surrounding water has drawbacks in view of ensuring the buoyancy. Its is therefor preferable if said buoyancy provides one or more floating spaces that are delimited at all sides with respect to the water environment and that are filled with a floating substance, such as air or a gas or some other material of relatively low specific weight. Said floating means can comprise e.g. a separate, inflatable, completely closed, diafragm type floating body, preferably within the suction pile, e.g. in the suction space. With e.g. a space of the suction pile that is open at its lower side, use can be made of an airtight bulkhead with which said opening can be sealed. If said bulkhead is at least substantially rigid, e.g. of metal, preferably steel, of sufficient thickness, it can withstand a pressure difference between said space and its environment by bearing bending stresses, hoop stresses or a combination of both. Then it is for realising and maintaining the desired buoyancy not necessary to bring this space to a pressure that is substantially higher than atmospheric pressure. If the bulkhead is substantially flexible, e.g. as an elastic or plastic well formable diafragm of e.g. rubber, it can be necessary for obtainig and maintaining sufficient buoyancy to bring this space to a pressure substantially higher than atmospheric pressure.

Concerning a water tight bulkhead at the under side of the suction pile, one can think of the following structural embodiments and ways of installing: The bulkhead is pressed down by a differential gas pressure within the floating space onto a bearing projecting inside into the suction pile and preferably being ring type to ensure sufficient air tightness. After lowering the suction pile it is position onto the subsea bottom, wherein said bottom raises said bulkhead from its seat. While the suction pile is sucked into the subsea bottom, the bulkhead remains in place onto the subsea bottom, such that the bulkhead eventually arrives close to the top cover of the suction pile. During pressing out, the bulkhead eventually comes to rest on its seat near the under side of the suction pile. The then fast increasing pressure within the suction pile due to the sealing action of the bulkhead is an indication that the pressing out is finished.

To bring the floating space to the desired pressure it is prefered that said space is hermetically delimited. It is then preferred, to connect the floating space with a convenient appliance to feed pressurised gas into said space.

The meaning of "delimited at all sides with respect to the water environment" here is that a boundary with respect to the surrounding air is not required. The meaning of "hermetically delimited" here is a boundary both with respect to the surrounding water and the surrounding air.

According to a variant that is preferred at this time, the tube like shell of the suction pile is extended beyond its top cover, such that a floating space is present above said top cover. In this way the lower side of the floating space is provided by a fixed bottom. To ensure its buoyancy, it is allowable if said floating space has an open top, unless during floating e.g. the upper edge of the suction pile comes below the water surface or waves flush over it. With a view to ensuring the buoyancy under all circumstances, it is however preferable, to make said top side water tight, prferably with a ridig cover. The extension part of the shell can be of the same structure as the shell part below the top cover. However, some other design (e.g. smaller wall thickness) could be used here because of the different mechanical load. This extension part could be integrated with the suction pile, or be disconnectable to be removed from the suction pile after use. The wall of the extension part can be in line with the shell wall of the suction pile below the top cover, but could also have a larger or smaller diameter. The floating space within the extension part is preferably connected to a water removing means, such as a bilge pump, such that incoming water can be removed. The extension part preferably provides a substantial length part of the suction pile, e.g. about half its length. At a total length of about 20 meter, the extension part has a length of e.g. about 10 meter if the extension part and shell wall of the suction space are in line.

The invention is also concerned with a method of transporting a suction pile over water since it is independently floating in the water, and a method of transporting a marine structure over water wherein use is made of one or more suction piles with buoyancy on which the marine structure is substantially floating. Apart from the the invention is concerned with a method of regaining of a suction pile or marine structure wherein, preferably after pressing out the suction pile from the subsea bottom, a floating space of the suction pile is freed from its ballast to get therewith buoyancy such that the suction pile preferably at least substantially can raise independently towards the water surface.

BRIEF DESCRIPTION OF THE DRAWINGS

Next, the invention is illustrated by way of several non-limiting examples, that are preferred at the moment. In the drawings is.

DESCRIPTION OF THE PREFERRED EMBODIMENTS

Figure 1:
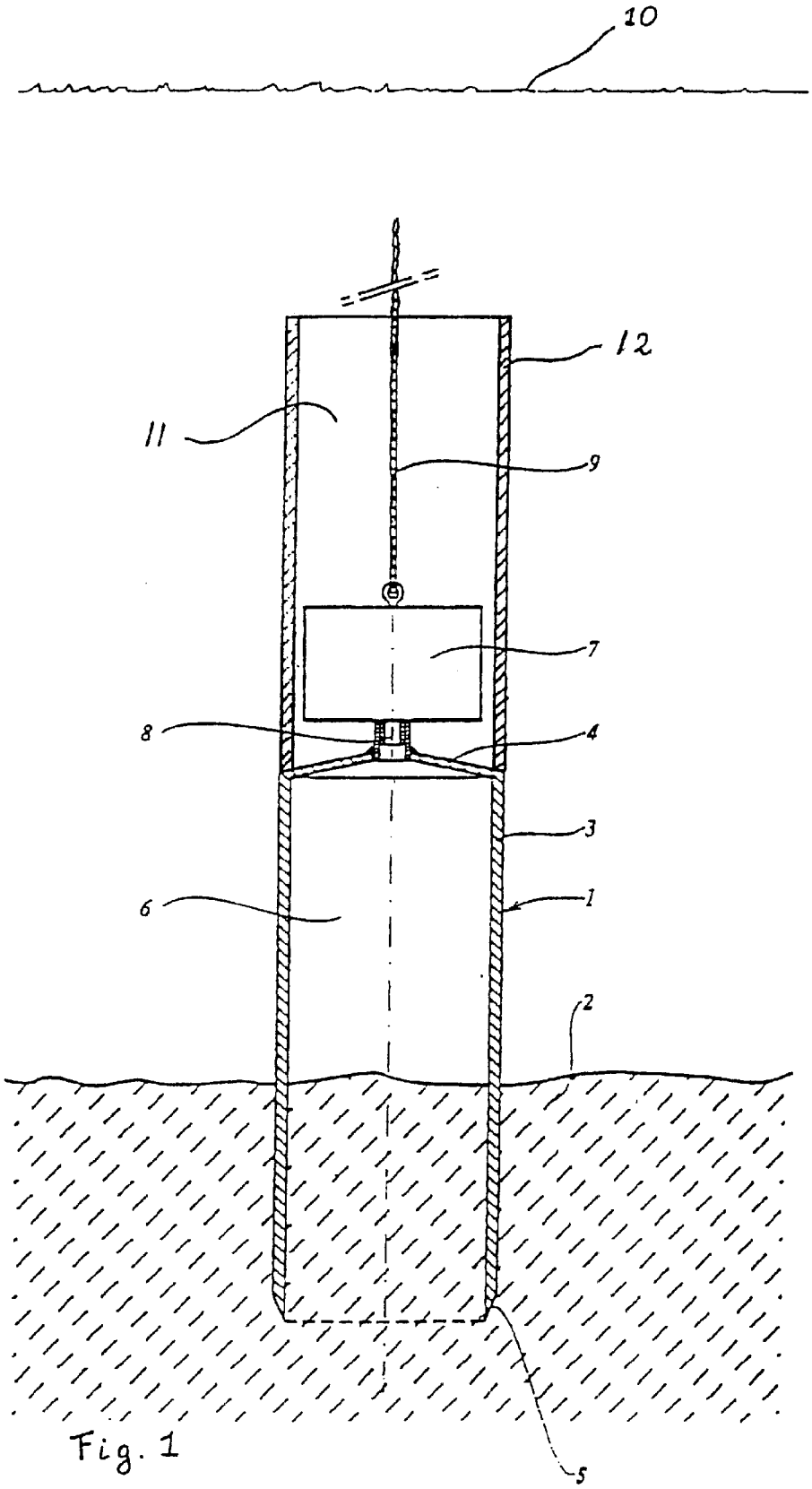
FIG. 1 a sectional side view of a first embodiment of the suction pile according to the invention.

In FIG. 1 the different parts are numbered as follows: Suction pile 1 (partly embedded into the subsea bottom 2); shell 3 (of the suction space 6; diameter 8 m); top cover 4; open under side 5 (of the suction space 6); suction space 6; pump 7 (to get the suction space 6 at a lowered respectively elevated pressure); connection pipe 8(to communicate space 6 and pump 7); power line 9 (to power pump 7); water surface 10; floating space 11; shell extension 12.

An alternative is as follows (not shown in the drawings): The suction pile contains an upwardly movable bulkhead, in this example a concrete ballast body, suspended from the suction pile such as with one or more cables or different flexible or bending stiff pull and/or push members, which possibly can be shortened and therefore e.g. can be wound onto an e.g. motoric driven winch. In this embodiment the suction space 6 and the floating space 11 are combined, which is e.g. material saving, but also limits the total mass and so the required buoyancy. A function of this movable bulkhead is to decrease the free opening at the lower side of the floating space, such that risc of floating medium (such as air) leaking through said opening is at least decreased, e.g.

by decreasing the influence of e.g. extern water currents on the inside of the floating space. In that case the bulkhead can keep a large clearance with the walls of the floating space, such that e.g. the risc of wedging during moving up and down of the bulkhead is at least small. For increased water and/or floatingmedium tightness, a sealant can be provided between the bulkhead and walls of the floating space, e.g. of yielding material such as rubber or elastomer. The bulkhead then also provides a hermetic sealed floating space. During floating the bulkhead can also be flushed by water at merely under side and possibly sides. However, the indicated water level above the bulkhead offers extra cushioning of the influence of water currents to the inside of the floating body.

For lowering it can be advantageous if the buoyancy of the floating space 11 can be easily removed, e.g. by a convenient means, such as a valve, possibly remotely opened, with which at some time water or another ballast means can be admitted into said floating space and/or floating means (such as the air or the one or more other gasses) can be vented.

Figures 2, 4:
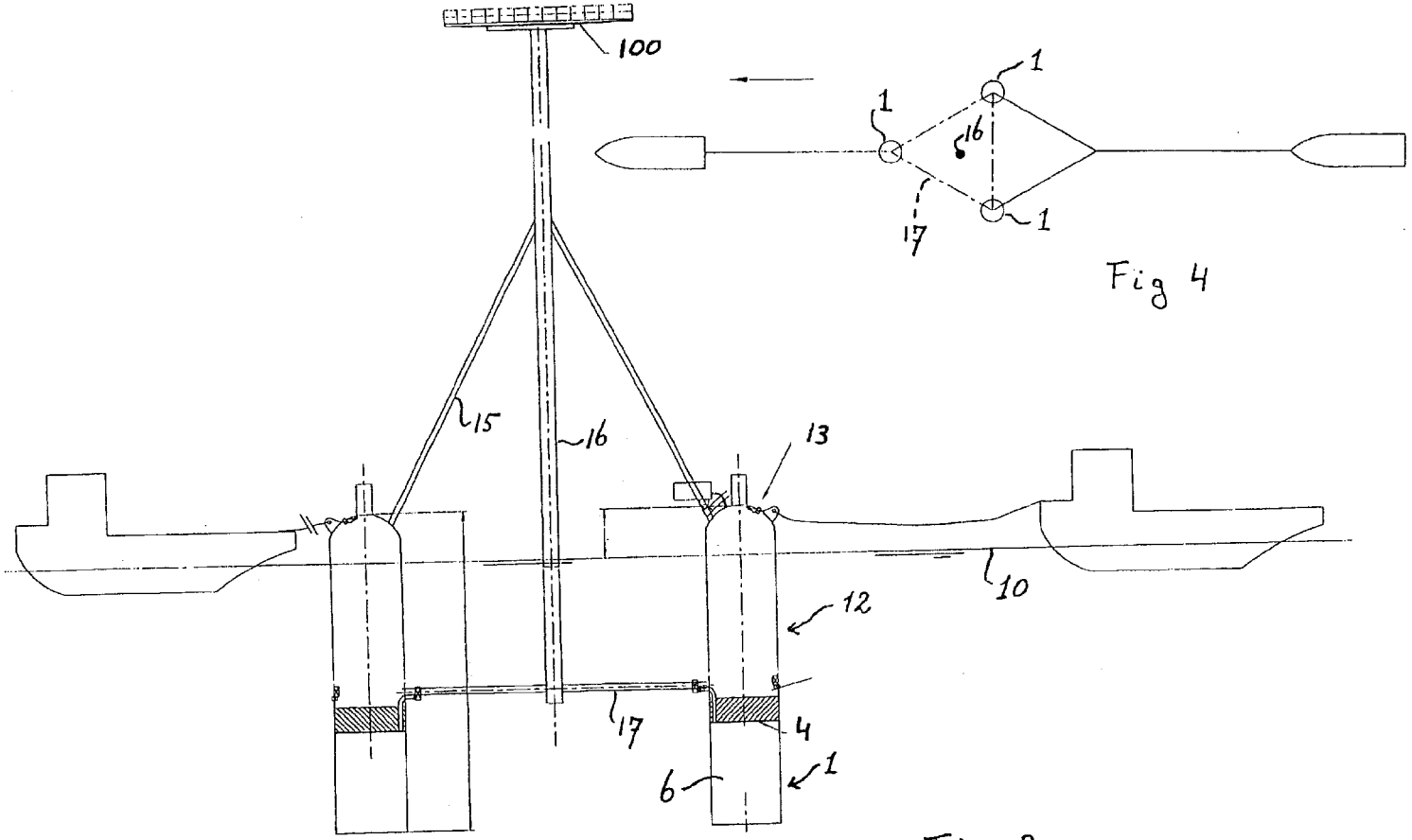
FIG. 2 a side view of a first embodiment of the marine structure according to the invention, during tug.
FIG. 4 the top view of FIG. 2.
Figure 3:
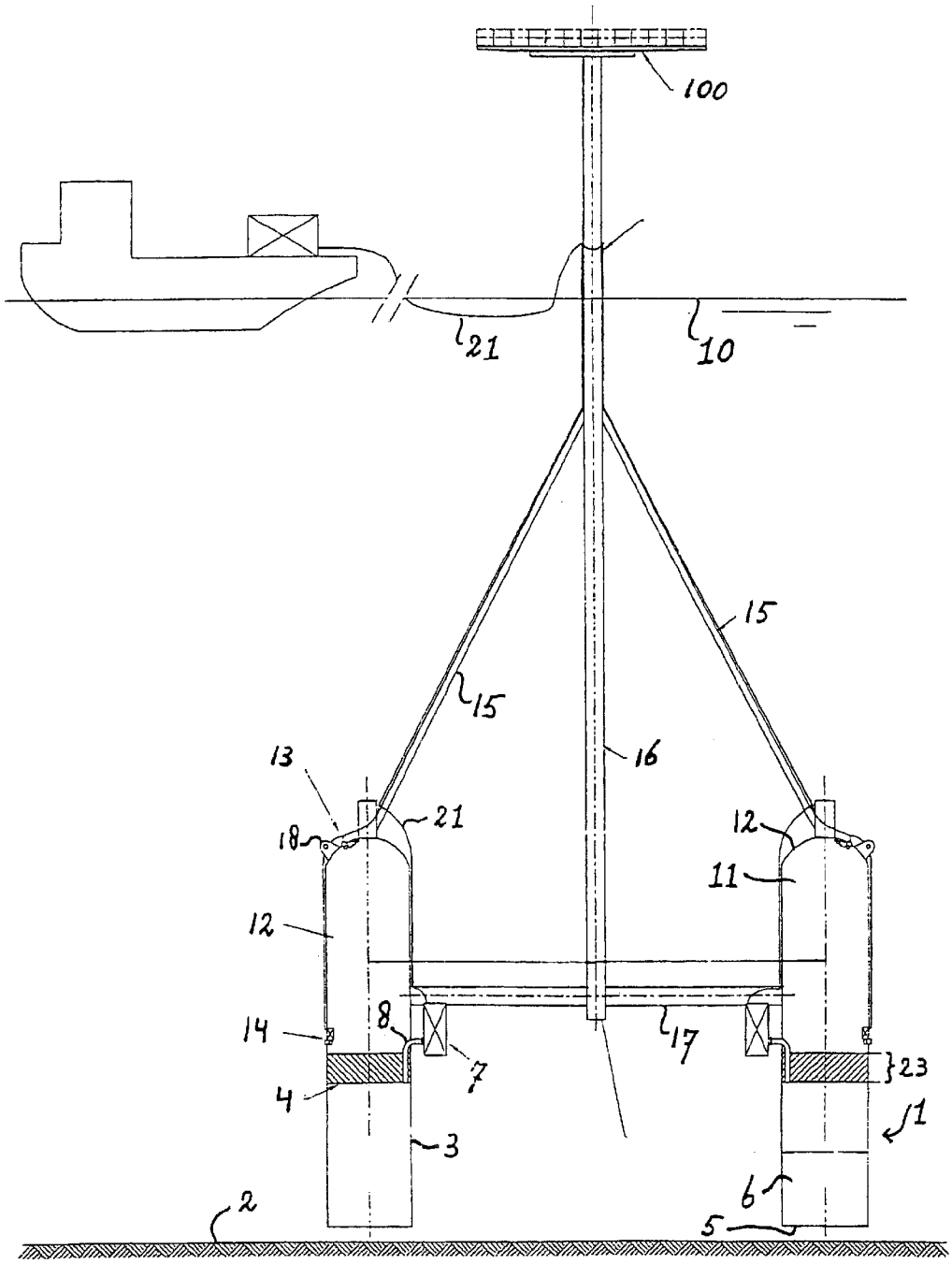
FIG. 3 the side view of FIG. 2, during lowering.

The marine structure according to FIG. 2 and 3 has a platform above the water surface and floating bodies provided by three suction piles. The platform can be designed for supporting the exploitation and/or exploration of oil and/or gas. The platform is e.g. 15 meters above the water surface. Indicated dimensions are in meters. Each suction pile 1 has an integrated, preferably rigid ballast body of e.g. concrete, to e.g. provide stability of the complete structure, in particular during lowering respectively rising. In this example the ballast body is located near the level of the bulkhead 4. The ballast body is supported by the bulkhead 4. The pressure point is above the centre of gravity. The air valve 13 is preferably at a high level, the water valve 14 is preferably at a low level of the floating space 11. The location of the pump 7 can differ, the same counts for the pipe 8. Although the struts 15 are flexural stiff elements, particularly tubes, they can possibly be flexural elements, particularly cables or equivalent The struts are each connected to a relevant suction pile and the riser 16. In top view the suction piles are located at the corners of a triangle of which the sides are provided by girder elements 17 fixed to the suction piles. The suction piles 17 are provided with connecting means 18 for a tug means 19. The cover 20 of the floating space is spherical. Air and electricity lines 21 for pumping air into the floating space respectively controlling the valves 13, 14 and the pump 7 are guided along the struts. During tow the structure is vertically oriented. The deck can possibly also be installed onto the mono pile 16 after the suction piles are embedded into the subsea bottom 2. The platform can possibly be replaced by appliances for oceanografic and/or morfologic measurements, or as navigation beacon, etc.

Figure 5:
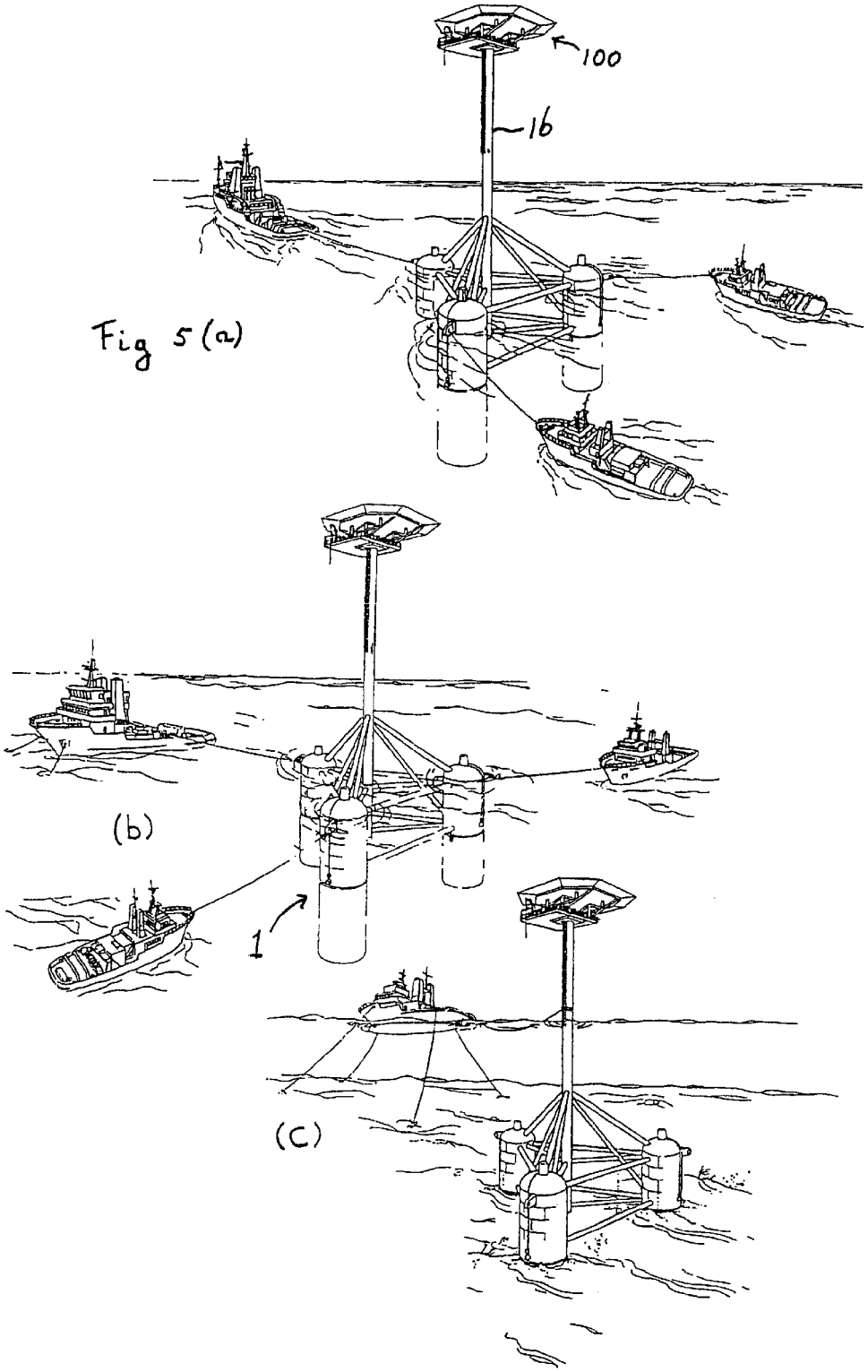
FIGS. 5*a–c* a prespective view, of an alternative structure of FIG. 2, during tug (5*a*), lowering (5*b*) and sucking of the suction pile (5*c*)
Figure 6:
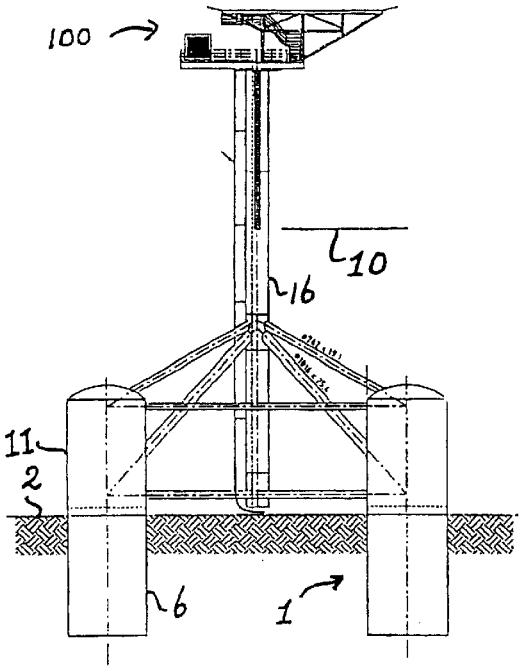
FIGS. 6–8 alternatives of FIG. 2.
Figure 9:
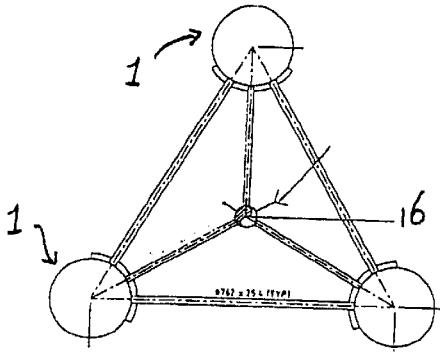
FIG. 9 a top view of FIG. 6.
Figure 7:
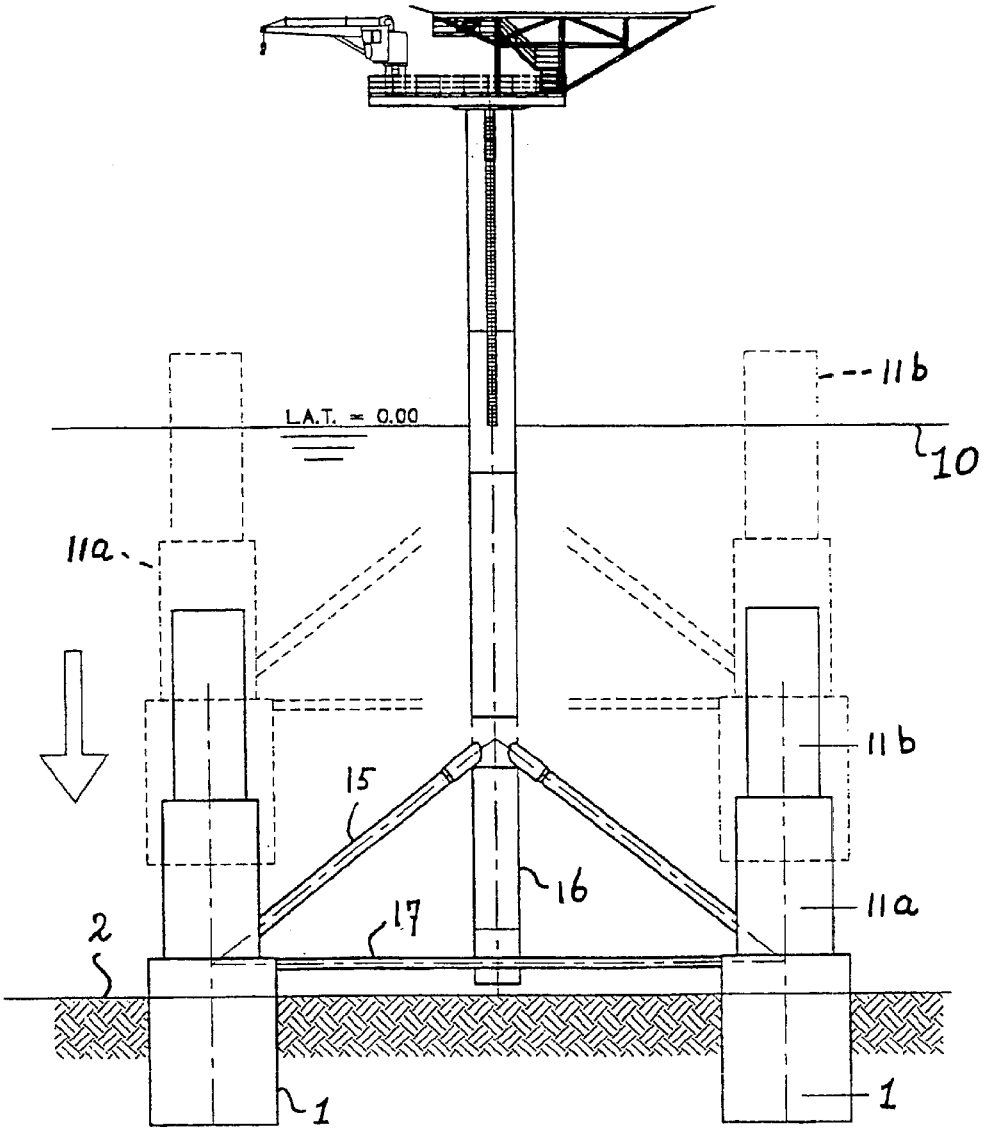
Figure 8:
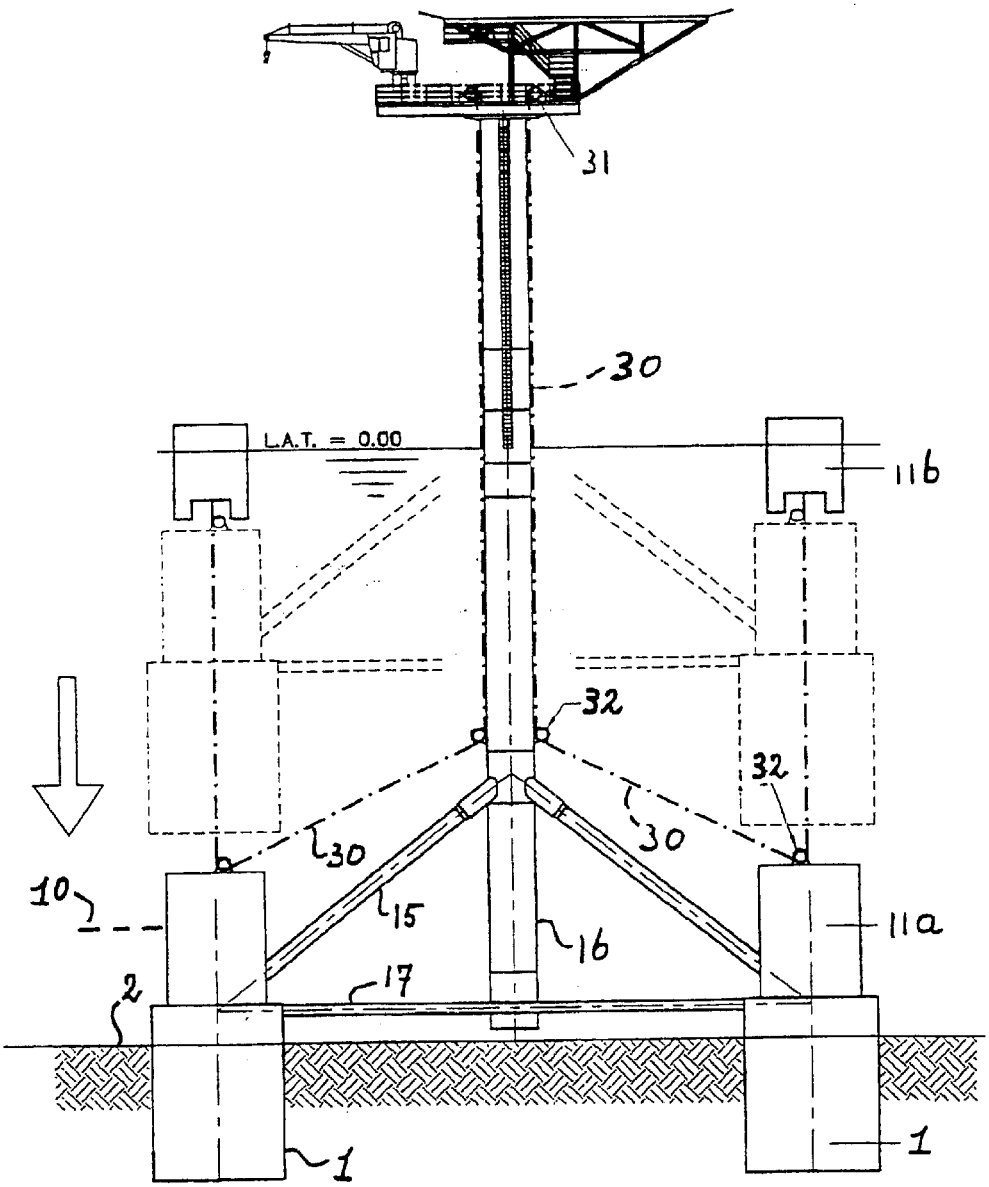

In FIG. 6–8 the situation as installed is shown. The alternative according to FIG. 6 differs from FIG. 2 generally in that the girder elements 17 extend at two different levels while the struts 15 are connected to the mono pile 16 at a lower level. As with FIG. 2, the adjacent suction piles 1 are mutually and each suction pile is fixed to the mono pile 16 by the girder elements 17 (view also FIG. 5).

FIG. 7 shows how the floating space is devided into a permanent space 11*a* and a temporary space 11*b* above. The temporary floating space 11*b* can be removed easily, e.g. after completion of the installation. Again, the buoyancy is concentrated at the suction piles 1. This embodiment offers more stability during lowering. During lowering the spaces 11*b* maintain their buoyancy for the longest period; that of the spaces 11*a* is decreased at an earlier moment in time. The permanent floating space 11*a* offers sufficient buoyancy during tow. For stability during lowering the spaces 11*b* preferably project such high, that they still project above the water surface 10 if the suction piles 1 contact the subsea bottom 2 with the under side. FIG. 8 shows how the temporary floating space 11*b* during lowering becomes more and more distant from the suction piles 1, while those spaces 11*b* offer buoyancy during lowering. The spaces 11*b* are therefor connected to the structure by extendable pulling elements; in this embodiment provided by cables 30 extending from a winch 31 via sheaves 32 to the respective spaces 11*b*. In FIG. 7 and 8 the situation during lowering is indicated with phantom lines. The water surface during tow is shown in phantom lines.

Figure 10:
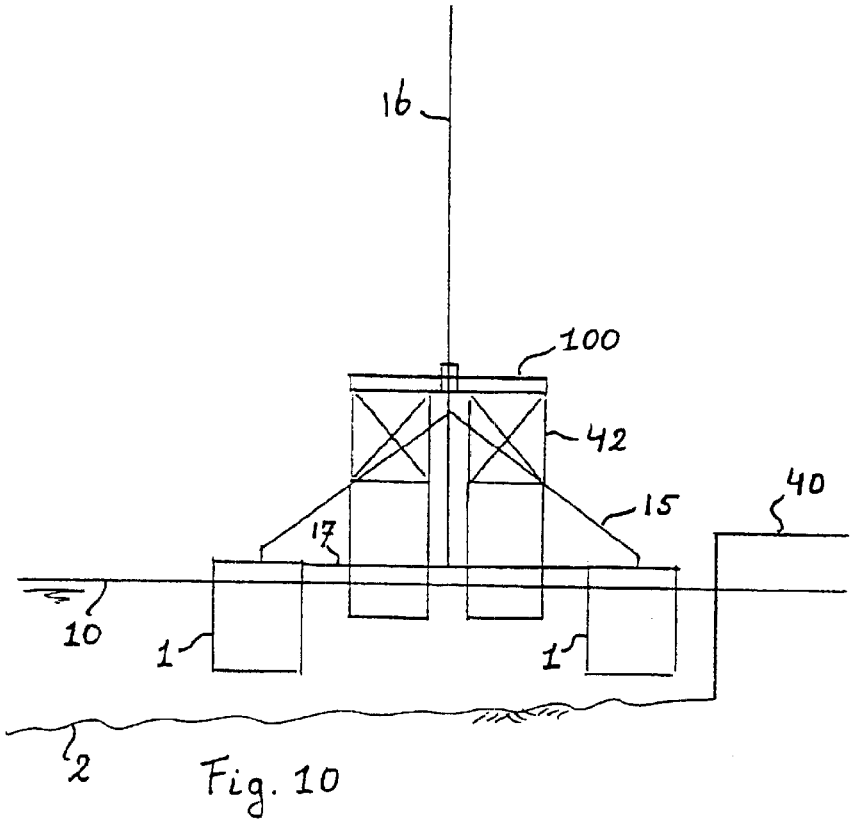
FIGS. 10–13 a further alternative of FIG. 2.

FIG. 10 shows of an alternative the situation in the harbour at the cade 40. The structure has maximum buoyancy. The deck 100 is in a low position. Floating tanks 42 are fixed below the deck 100 and provide buoyancy (air filled). The suction piles 1 provide also buoyancy (air filled). The draught is therewith small.

Figure 11:
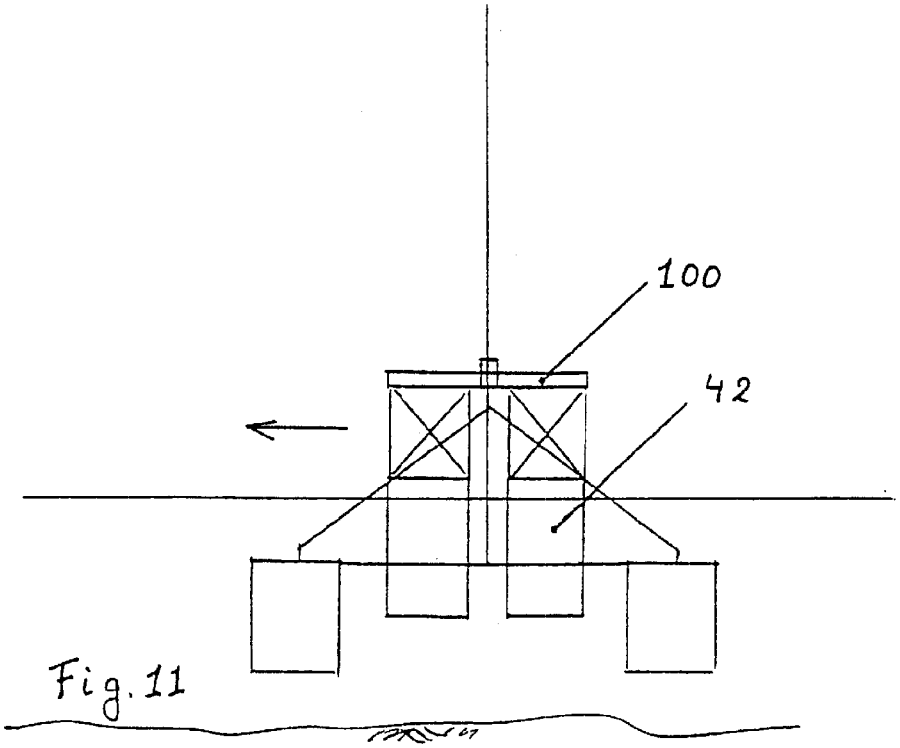

During tow at full sea (FIG. 11) the buoyancy of the structure is smaller, e.g. for improved stability. In this case the suction piles 1 provide hardly or no buoyancy.

Figure 12:
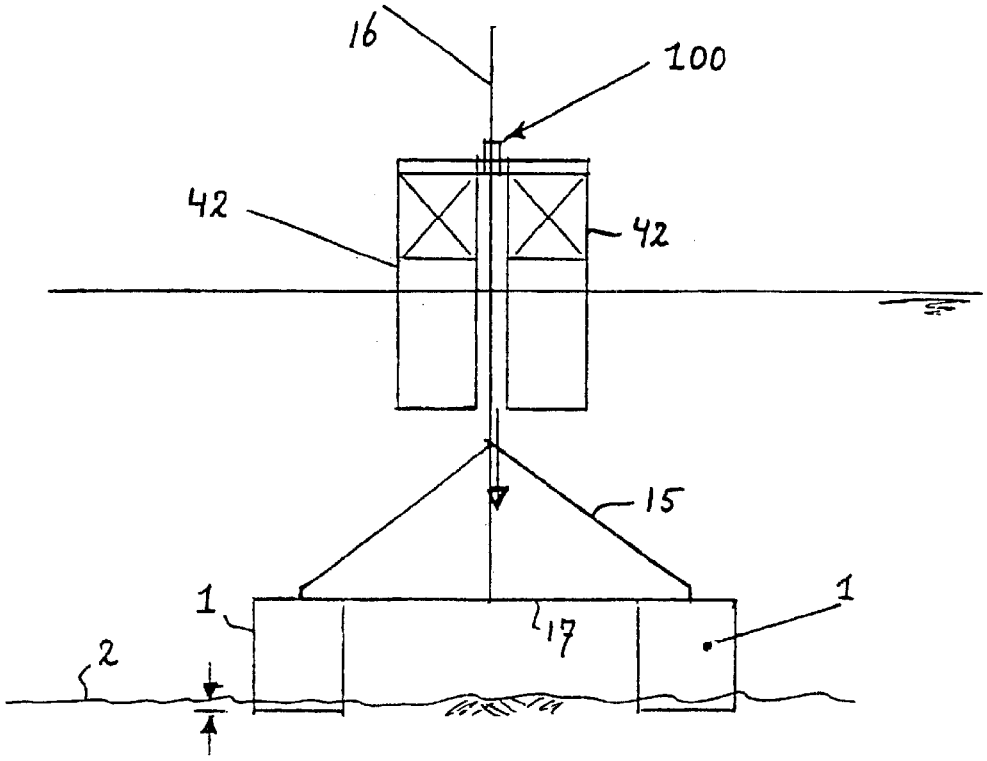

During lowering onto the subsea bottom 2 (FIG. 12), deck 100 and the suction piles 1 are moved apart. The floating tanks 42 and the suction piles 1 also move apart. The suction piles are sucked into the subsea bottom 2.

Figure 13:
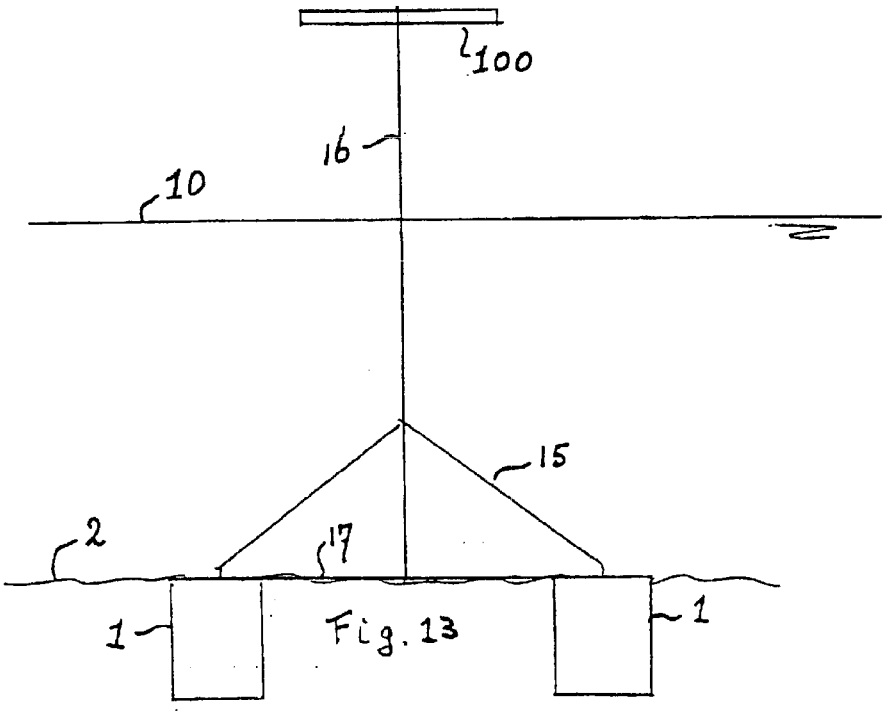

FIG. 13 shows the final situation. The floating tanks 42 have been removed. The deck 100 is located higher above the water surface 10. A bearing structure (in this case a "mono pile") 16 extends from the deck 100 towards the subsea bottom 2. The deck 100 is moved along the mono pile. Said moving can be done by a lifting or jacking system.

The suction piles 1 are maintained in mutual position by coupling structures 17, and via supporting structures they bear the bearing structure 16. In the embodiment shown both elements 15 and 17 are bending stiff inclined respectively horizontal arms. During floating transport the floating tanks 42 are preferably located between said elements 15 and 17.

Figure 14:
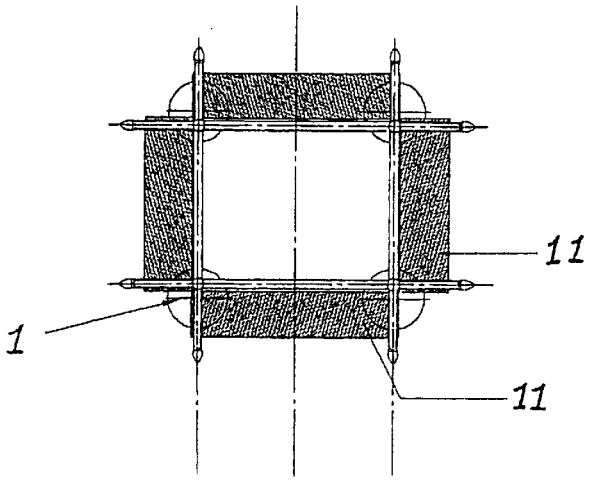
FIG. 14 still a further alternative of FIG. 2.

FIG. 14 shows in side and top view a marine structure that, once installed, completely disappears in the water (subsea structure, e.g. template). It is equipped with appliances for oil and/or gas production and is connected to an already drilled production well. The floating tanks 42 are located in the indicated positions.

Figure 15:
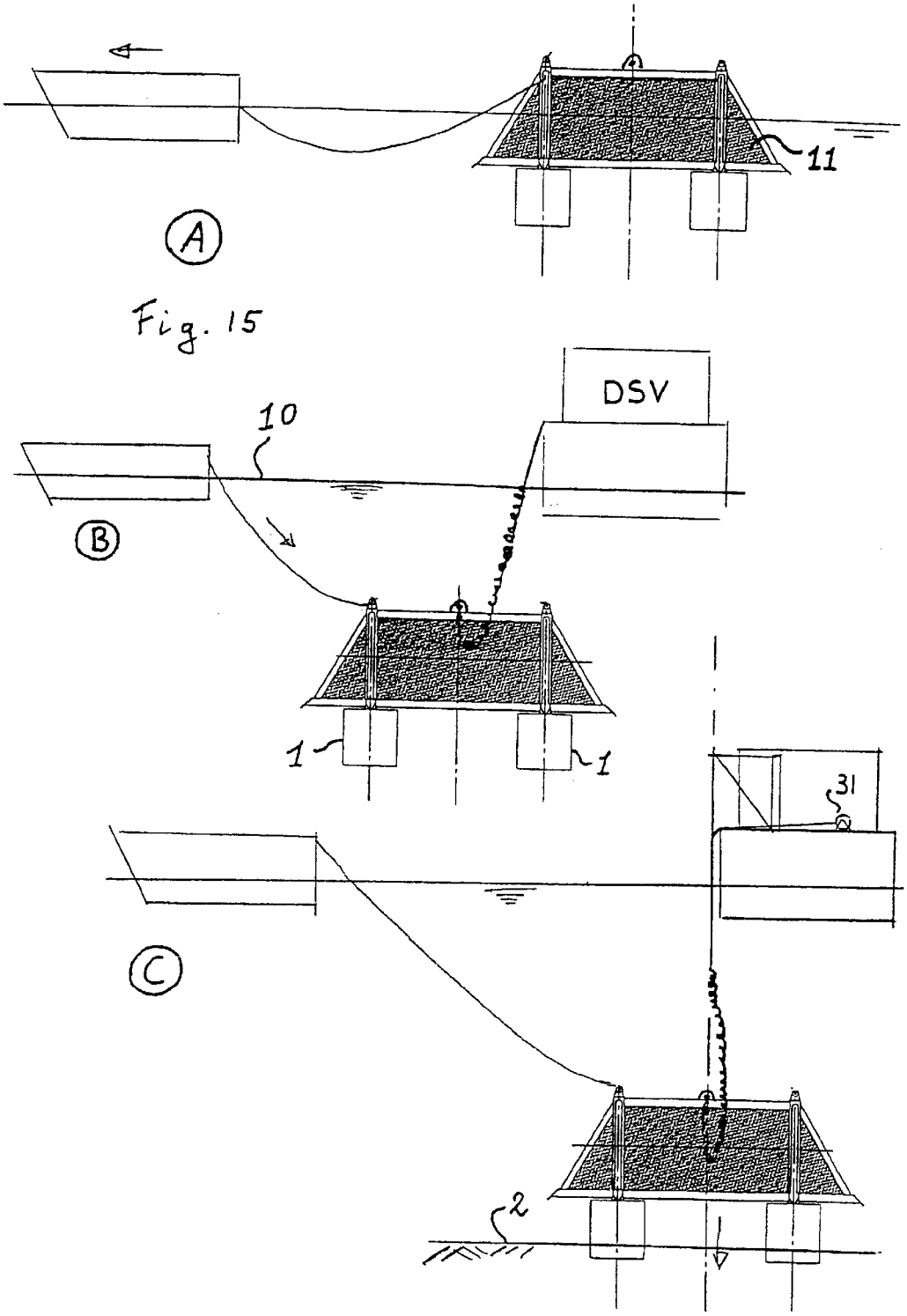
FIGS. 15*a–c* a side view of FIG. 14.

FIG. 15*a*–*c* shows three different steps for installing the subsea structure. Firts it is towed (FIG. 15*a*). Next the ballast tanks 42 are filles, wherein with one or more pulling cables the stability is ensured (15*b*). Finally the suction piles 1 are sucked into the subsea bottom.

The invention also covers embodiments that are developed by combining one or more aspects of an embodiment described in here with one or more apects of one or more of the other embodiments described in here. In this respect a possible embodiment is wherein the usually open under side of the suction pile is fluid tight sealed with a bulkhead, while the suction pile is extended above the top cover, such that the suction pile has two separate floating spces and so an increased buoyancy. According to a further alternative a floating space can be provided by foam with closed cells, e.g. individual globules of styropor with each a diameter of e.g. about 3 mm, with which the suction space could be filled, the purpose of which is that it is removed, e.g. by pumping, to remove the buoyancy to e.g. lower the suction pile. Such foam, particularly if its is sufficient rigid, in combination with a yielding bulhead, requires no provision and maintaining of an over pressure within the floating space. Such rigid foam can be maintained in position within the floating space by a grid with sufficient fine mesh, wherein said grid provides e.g. the boundary with the water of air surroundings. Each foam cell can be viewed as an hermetically sealed floating space in this, case.

A marine structure with more, e.g. with four, or less than three suction piles is also feasible.

The invention is also concerned with the application of the suction pile for providing the foundation of support of a body, such that the suction pile is exposed to both a load pressing it into the subsea bottom and a turn, roll or pitch torque from the supported body. Prior to installation in the subsea bottom, the suction pile can be irremovably connected with the structure to be carried, e.g. be connected thereto by weld joints. However it is preferable from the view point of e.g. installation, to provide the suction pile with coupling means allowing afterwards coupling of the suction pile with the structure to be carried, e.g. after the suction pile. is positioned on the subsea bottom and possibly has lowered itself into the subsea bottom to the desired depth, or an intermediate depth. Said coupling means are e.g. one or more flanges with bolts and nuts, known as such. A more advantageous couling means at the suction pile is adapted to remotely and/or automatically make the mechanical coupling with the structure to be supported , e.g. with one or more moving parts for hooking or snapping together with counter parts at the structure to be supported, or with one or more parts with which moving parts at the counter-coupling part of the structure to be supported can be brought to a load bridging engagement. Such coupling means are e.g. known as such in the field of load carrying coupling of a marine structure with a pile rammed into the subsea bottom, which is substantially more slender than a suction pile and has no provisions to be sucked into the subsea bottom. The coupling means are preferably adapted for transmitting a preferably substantial pulling or pushing force and/or substantial torque. Said torque can come from a load exerted onto the structure to be supported and trying to turn it around an upright and/or one or two orthogonal axes, in respect of which the term rotating moment or rotating torque, repsectively tilting moment or tilting couple, respectively pitching moment or pitching torque is used here. If the suction pile is applied in a single pile foundation with only one suction pile, e.g. for supporting a structure located under water such as a so called template or drilling template (mass e.g. 20 tonnes), or e.g. for supporting a structure extending above water and resting in the subsea bottom, such as a wind turbine of e.g. 1 MWatt or more, said coupling means must be adapted both for transmitting substantial compression forces and substantial tilting, pitching, and rotating moments.

It will be obvious to the skilled person, how strong the coupling means have to be designed to safely transmit the compression forces an/or torques. In that case the skilled person can e.g. find a basis in the coupling between the known pile rammed into the subsea bottom and the structure to be supported.

Apart from these coupling means the suction pile can have appliances for erg. hoisting of the suction pile or connection to a suction or pressure source and possibly one or more valves to selectively close the suction space within the suction pile.

As such the invention also provides a novel suction pile with appliances such that it is adapted for supporting materials or devices of equipment of some type and a predetermined mass of preferably at least about 5000 kg that are used for all kinds of applications in or above water, indeed or not in connection with exploitation of minerals such as oil or gas, e.g. bodies that were until now supported by one or more piles rammed into the subsea bottom.

The invention offers one or more of the following advantageous: ease of use, ease of regaining the suction pile, cheap installation of the suction pile, possibility of first installing the foundation and then the body to be supported, robustness, more reliable foundation, improved bearing of compression forces and/or rotating or pitch or tilting moments/torques such that the foundation can be simplified under circumstances (e.g. one suction piles in stead of two ramming piles, e.g. to prevent the structure to be supported from turning around its shaft), ease of installation due to the possibility to, e.g., locate the body to be supported onto the e.g. upright floating or (in shallow water) onto the subsea bottom positioned or possibly partly into the subsea bottom penetrated suction pile while subsequently taking the body to be supported to the desired level since the suction pile penetrates further into the subsea bottom (and vice versa for regaining the body to be supported).

It is appreciated that with the novel application the suction pile, and therewith its coupling means, can also be exposed to a tension load, e.g. from the body to be supported and/or since the suction pile also serves as an anchor for some different, non-bearing body.

So the invention is according to the enclosed claims.

What is claimed is:

1. A self-floating and self-foundating marine structure floating in a body of water and comprising:

a foundation part with one or more suction piles for embedment into the subsea bottom; and a construction above said foundation part, said construction having insufficient buoyancy to keep itself floating, said construction being configured to bear on said foundation part when the marine structure is installed into the subsea bottom, the overall structure having buoyancy sufficient such that the structure as a whole can be transported over water independently floating, wherein the suction piles provide buoyancy so that the overall structure at least partly floats by the suction piles.

2. The self-floating and self-foundating marine structure according to claim 1, wherein the buoyancy is such that if the one or more suction piles touch the subsea bottom with their under sides, at least part of the structure remains unsubmerged.

3. The self-floating and self-foundating marine structure of claim 1, wherein the structure has three suction piles at the most, each at a corner of an imaginated triangle.

4. The self-floating and self-foundating marine structure according to claim 1, wherein at least a part of the construction remains projecting above the water surface when the marine structure is installed into the subsea bottom.

5. The self-floating and self-foundating marine structure according to claim 1, wherein the structure slenders upwardly from the one or more suction piles.

6. The self-floating and self-foundating marine structure according to claim 1, further comprising a platform that can move up and down.

7. The self-floating and self-foundating marine structure according to claim 1, wherein the overall structure is completely submergible.

8. The self-floating and self-foundating marine structure of claim 1, wherein the structure is transportable in the upright position.

9. The self-floating and self-foundating marine structure of claim 1, wherein the buoyancy is concentrated in line with the one or more suction piles there above.

10. The self-floating and self-foundating marine structure of claim 1, wherein the structure has a pyramid form.

11. The self-floating and self-foundating marine structure of claim 1, wherein the construction is a platform.

12. The self-floating and self-foundating marine structure of claim 1, wherein the construction is a template.

13. A self-floating and self-foundating marine structure floating in a body of water and comprising:

a foundation part with one or more suction piles for embedment into the subsea bottom; and a construction above said foundation part, said construction having insufficient buoyancy to keep itself floating, said construction being configured to bear on said foundation part when the marine structure is installed into the subsea bottom, the overall structure having buoyancy sufficient such that the structure as a whole can be transported over water independently floating, wherein the suction piles include an upward extension providing buoyancy so that the overall structure at least partly floats by said extension.

14. The self-floating and self-foundating marine structure of claim 13, wherein the extension is removably connected to the suction pile.

15. The self-floating and self-foundating marine structure according to claim 13, wherein the extension is connected to the suction pile by an extendable cable.

16. The self-floating and self-foundating marine structure according to claim 13, wherein said suction piles provide no buoyancy.

17. The self-floating and self-foundating marine structure of claim 13, wherein the suction piles provide buoyancy so that the overall structure at least partly floats by the suction piles, the upward extension is removably connected to the suction piles, and the suction piles and extensions are configured to be lowered together when lowering and embedding the suction piles in the subsea bottom.

18. The self-floating and self-foundating marine structure of claim 17, wherein the extensions are connected to the suctions piles by extendable cables.

19. A self-floating and self-foundating marine structure floating in a body of water and comprising:

a foundation part with one or more suction piles for embedment into the subsea bottom;

a construction above said foundation part, said construction having insufficient buoyancy to keep itself floating, said construction being configured to bear on said foundation part when the marine structure is installed into the subsea bottom, the overall structure having buoyancy sufficient such that the structure as a whole can be transported over water independently floating; and parts providing buoyance so that the overall structure at least partly floats by said parts, wherein the suction piles and said parts are configured to be lowered together for lowering and embedding said suction piles in the subsea bottom.

20. The self-floating and self-foundating marine structure according to claim 19, wherein said suction piles provide no buoyancy.

* * * * *